US007110847B2

(12) United States Patent
Ostyn

(10) Patent No.: US 7,110,847 B2
(45) Date of Patent: Sep. 19, 2006

(54) METHOD FOR ADJUSTING THE WEAVING PARAMETERS OF WEAVING MACHINES, AND CONTROL DEVICE

(75) Inventor: Geert Ostyn, Moorslede (BE)

(73) Assignee: Picanol N.V., Ypres (BE)

( * ) Notice: Subject to any disclaimer, the term of this patent is extended or adjusted under 35 U.S.C. 154(b) by 280 days.

(21) Appl. No.: 10/240,752

(22) PCT Filed: Apr. 14, 2001

(86) PCT No.: PCT/EP01/04286

§ 371 (c)(1),
(2), (4) Date: Oct. 11, 2002

(87) PCT Pub. No.: WO01/79597

PCT Pub. Date: Oct. 25, 2001

(65) Prior Publication Data

US 2003/0140980 A1 Jul. 31, 2003

(30) Foreign Application Priority Data

Apr. 14, 2000 (BE) ..... 2000/0273

(51) Int. Cl.
*G06F 19/00* (2006.01)

(52) U.S. Cl. ..... 700/140

(58) Field of Classification Search ..... 700/140, 700/130; 139/1 R, 1 E
See application file for complete search history.

(56) References Cited

U.S. PATENT DOCUMENTS

| | | | | |
|---|---|---|---|---|
| 4,458,726 | A | 7/1984 | Wenig | |
| 4,673,004 | A | 6/1987 | Rosseel et al. | |
| 5,034,897 | A * | 7/1991 | Sainen | 700/140 |
| 6,148,872 | A * | 11/2000 | Wahhoud et al. | 139/435.1 |
| 6,314,335 | B1 * | 11/2001 | Sainen et al. | 700/140 |

FOREIGN PATENT DOCUMENTS

| | | |
|---|---|---|
| EP | 0234064 A2 | 9/1987 |
| EP | 0458753 A1 | 11/1991 |

* cited by examiner

*Primary Examiner*—Peter Nerbun
(74) *Attorney, Agent, or Firm*—Bacon & Thomas PLLC

(57) ABSTRACT

A method to adjust weaving parameters of weaving machines when changing the weaving rate based on optimized weaving-parameter values, one or more altering functions being used to determine and adjust weaving-parameter values which match the changed weaving rate.

10 Claims, 1 Drawing Sheet

METHOD FOR ADJUSTING THE WEAVING PARAMETERS OF WEAVING MACHINES, AND CONTROL DEVICE

BACKGROUND OF THE INVENTION

A. Field

The present invention relates to a method for setting weaving parameters for weaving machines and to a control system.

B. Related Art

It is known with respect to weaving machines to store in a control unit of the weaving machine such weaving parameters as the pressure and/or the rate of compressed air fed to a nozzle, the beginning and/or the duration of the feed of compressed air to the nozzle, the time a filling is severed, the time a filling is released at the prewinder and other weaving parameters.

It is known from the U.S. Pat. Nos. 4,458,726 and 4,673,004 to use regulation to change certain weaving parameters as a function of the measured time of arrival of a filling at a stop motion in order to assure that an ensuing filling shall arrive at a given moment within the weaving cycle.

It is furthermore known to specify standard weaving-parameter values for predetermined weaving rates or angular speeds of the weaving machine for given yarns to be processed and/or for predetermined weaving patterns, and to transmit said standards by means of an insertable chip card or by means of a network to the weaving machine and/or to store said values in the control unit of a particular weaving machine. The weaving-parameter standard values result in a setting by means of which a weaving machine may process a predetermined yarn at a predetermined weaving pattern and at a predetermined weaving rate. Such standard values of the weaving parameters illustratively are empirically ascertained by the weaving-machine manufacturer.

The operator will determine the rate of weaving when a fabric must be made on a weaving machine. Depending on the yarn to be processed and/or the weaving pattern, the operator selects a set of weaving-parameter standard values. Thereupon the operator begins operating the weaving machine at the standard setting, that is with the weaving-parameter standard values. Next the operator optimizes the weaving-parameter values until the machine is able to optimally manufacture a fabric, that is, for instance to make a fabric of optically unobjectionable appearance that shall be woven with minimal air consumption and with a minimal number of ruptured fillings and/or warps.

When weaving with a predetermined pattern containing a filling pattern of different yearns, for example for each different yarn of the fillings there is selected initially in corresponding manner a setting of the standard values of the weaving parameters which subsequently are optimized in the above described manner by the operator. In corresponding manner, binding patterns whereby the warps bind the fillings, warp tensioning patterns or combinations of said patterns may be taken into account in optimization. As a result, optimizing the values of the weaving parameters demands a fair amount of time, especially where different kinds of fillings must be processed using different weaving patterns.

When the operator changes the weaving rate (weaving machine angular speed) for instance to check whether a fabric of the same quality might be woven at a higher speed, he/she again selects a setting comprising a set of standard values of the weaving parameters that relate to said weaving speed. Thereafter the operator must optimize the weaving-parameter values for each kind of filling and/or each kind of binding and/or different warp tension patterns and/or combinations thereof. Such work optimizing the weaving-parameter values requires substantial time and as a result the weaving rates frequently will not be matched to actual conditions.

BRIEF SUMMARY OF THE INVENTION

The objective of the present invention is a method for simplifying the setting of weaving parameters and in particular to carry out weaving and/or checking weaving feasibilities at different weaving rates.

This problem is solved in that, by means of the instantaneous values of weaving parameters and of one or more altering functions relating to one weaving rate, such values shall be ascertained and adjusted for the weaving parameters which match the changed weaving rate.

The invention assumes that the weaving parameter values matching in this manner the changed weaving rate shall substantially agree with the weaving-parameter values optimized for that weaving rate. As a result the operator advantageously need carry out only minor corrections and/or adjustments in order to attain the optimal weaving-parameter values for the changed weaving speed, and therefore optimal weaving parameters regarding the changed weaving rate shall be arrived at relatively quickly.

Because the weaving-parameter values matching the changed weaving rate are ascertained and adjusted automatically, the invention furthermore offers the advantage—especially where a drive disclosed in applicant's WO 99/27426 is used—that when passing from one weaving rate to another, the weaving machine shall continue weaving. After changing the weaving rate, a subsequent filling insertion arrives still within the predetermined tolerance at a stop motion and consequently no stoppage of the weaving machine takes place. Therefore the weaving rate of the weaving machine may be changed during weaving and therefore the operator may directly ascertain the effect of weaving rate and its changes on fabric quality. Eliminating stopping the weaving machine furthermore means that starting stripes in the fabric may be avoided. Because one can weave further, also no time will be lost as a result of the changing of weaving rate. Depending on the fabric to be produced, the operator then may carry out further adjustments or changes in the weaving parameters. Because the automatically selected new set of weaving parameters is nearly optimal, the final optimal setting may be reached rapidly. When weaving-parameter values can be matched automatically, for instance as function of the time of arrival of the filling at the stop motion, then, based on the set of weaving parameters calculated by the altering function, small adjustments automatically caused by measured data or measurement results can lead to a set of optimal weaving-parameter values relating to the changed speed, without intervention of the operator.

The invention is especially advantageous also as regards weaving machines operating according to a speed pattern, that is at different weaving rates for different filling insertions. Illustratively each filling insertion is carried out at its own appropriate weaving rate. The invention makes it possible optimizing the weaving parameter values for one kind of filling and then to use matched values of weaving parameters matching by means of the altering function for the kind of fillings belonging to other weaving rates. In other words, the operator is able to optimally adjust one set of weaving parameter values for a given, constant weaving rate and then to allow the weaving machine to run according to a speed pattern. For each filling to be inserted at its appropriate weaving rate, the weaving machine then selects a matching set of values of weaving parameters that is nearly optimal. This design offers advantages foremost when weaving with a weaving pattern consisting of a combination of a speed pattern a warp tensioning pattern, a filling pattern and/or a binding pattern because in such a case the operator would have considerable difficulties attaining optimal settings for each combination.

In one preferred embodiment, the method of the invention includes the determination of the present optimized set of weaving parameters for each filling insertion of a weaving pattern and the determination of a new set of weaving parameters for the filling insertion of the weaving pattern when the weaving rate has been changed by matching the present, optimized set of weaving parameters using an altering function.

In one embodiment, the altering function is determined as a function of the weaving parameters of a standard setting for a first weaving rate and of the weaving parameters of a standard setting for a second weaving rate. Preferably the first weaving rate is substantially the same as the instantaneous weaving rate and/or the second weaving rate is substantially the same as the changed weaving rate. This method is especially appropriate when the operator changes for the first time the weaving rate of an optimally adjusted weaving machine.

In a preferred embodiment, the altering function is determined as a function of at least one optimally set of weaving parameters at a predetermined weaving rate. As regards a weaving machine for which one set of optimal weaving parameter values was already determined for two weaving rates, there will be the possibility to determine relatively exactly the altering function for the transition to weaving with a third weaving rate as a function of the two optimally selected values of the weaving parameters and in this manner to attain a practically optimal set of weaving parameters for the third weaving rate. Such an altering function also may be determined relative to two optimally selected sets of weaving parameter values to weave another fabric at two different weaving rates.

In a preferred embodiment, the altering function is continuously adjusted as a function of at least one set of optimized weaving parameter values. Preferably in this case the altering function is adjusted relative to each automatically selected set of weaving parameter values. As a result, the altering function may be determined in the most accurate possible way and consequently, when a weaving rate has been changed, the automatic adjustment of the new set of weaving parameter values shall be restricted. This feature shall be foremost advantageous when a filling is processed at different weaving rates on a weaving machine.

In a preferred embodiment, the altering function is determined depending on at least one already known altering function and by the changed weaving rate. As a result and in an illustrative manner, where at least two altering functions are known as regards changing between different weaving rates, a new altering function may be determined which depends on the already determined altering functions of the next weaving rate as regards changing to a subsequent weaving rate.

In a preferred embodiment, the change from a first weaving rate to a second weaving rate is accompanied by a stepwise change of the first weaving rate by means of an intermediate weaving rate between the first and second weaving rates. In each instance a set of weaving parameters for a subsequent weaving rate is determined depending on the previous set of weaving parameters according to an associated altering function. Preferably the set of weaving parameters is adjusted automatically for each intermediate speed. Then depending on the automatically adjusted set of weaving parameters, a weaving parameter set for a subsequent weaving rate shall be determined. This feature is advantageous primarily when the first and second weaving rates are substantially different.

Preferably one of the above said altering functions shall be determined for each kind of filling to be processed. This feature offers the advantage that the altering function may be optimally selected for each kind of filling.

The objective of the invention also shall be attained using a control system to carry out the method, said system containing means to ascertain and adjust weaving parameter values adjusted to a new weaving rate by means of instantaneous values of weaving parameters for a given weaving rate and by means of one or several altering functions when changing to the new weaving rate.

Further features and advantage of the present invention are elucidated in the following description of an illustrative implementation of the present invention and in the dependent claims.

DETAILED DESCRIPTION OF PREFERRED EMBODIMENTS OF THE INVENTION

The attached drawing schematically shows an airjet weaving machine fitted with a control system of the present invention.

DESCRIPTION OF THE DRAWING

The airjet weaving machines is fitted with a control unit 1. In the manner described in the specification of U.S. Pat. No. 4,673,004, a filling is taken off a prewinder 2 comprising a controlled magnetic clamp 3 and is blown by a main nozzle 4 into a shed. Each main nozzle 4 is supplied with compressed air by means of a controlled valve device 5. The filling is guided through the shed by relay nozzles 6 which are each fed with compressed air from a valve device 7. Illustratively the valve devices 5 and 7 are designed in a manner disclosed in the patent documents U.S. Pat. No. 5,086,812, WO 97/29231 or WO 99/64651.

The arrival of the filling at the other shed side is monitored using a stop motion 8. An inserted filling is severed using a controlled filling scissors 9 such as is known for instance from U.S. Pat. No. 4,834,145. As regards this particular illustrative embodiment, a tensioning nozzle 10 as disclosed in U.S. Pat. No. 5,226,458 is also provided and is fed with compressed air from a valve device 11. This illustrative embodiment also includes a controlled yarn brake 12 for instance as known from U.S. Pat. No. 5,226,459.

Figure 1:
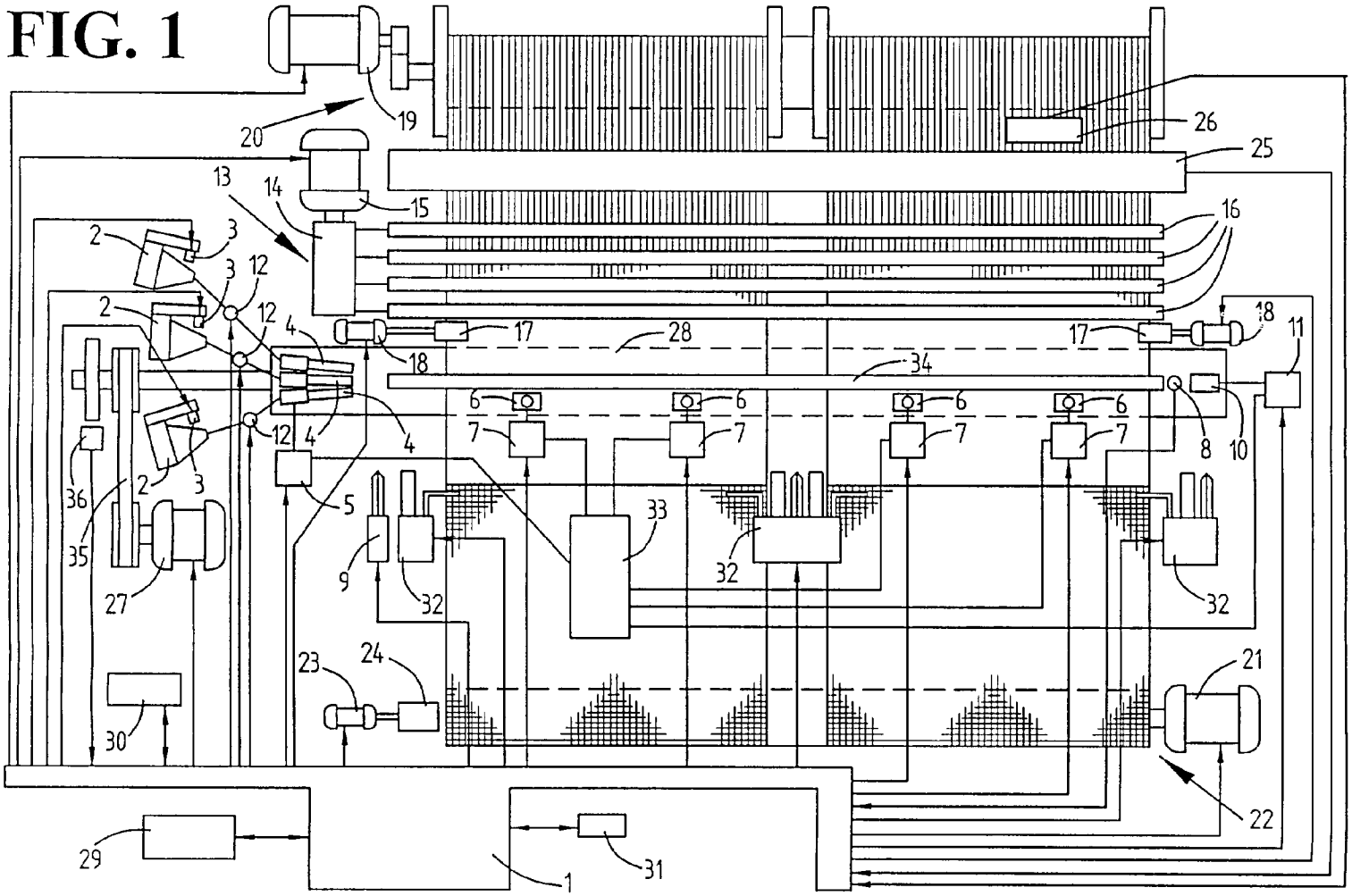

The airjet weaving machine furthermore contains controlled shed forming means 13, for example an electrically controlled selection device 14 driven by a controlled drive motor 15 and in turn driving the harnesses 16. In another embodiment, each harness or even each warp is driven by its own controlled drive motor.

The airjet weaving machine furthermore contains a selvage device 17 fitted with a controlled drive motor 18, known for instance from the patent documents U.S. Pat. No. 5,803,133 or WO 98/14651. The airjet weaving machine shown in the illustrative embodiment also comprises a warp letoff 20 with a controlled drive motor 19, and a fabric takeoff device 22 with a controlled drive motor 21, a waste-removal device 24 with a controlled drive motor 23, a warp stop motion 25 and a warp tension sensor 26.

The airjet weaving machine comprises a controlled main drive motor 27 which primarily drives a batten 28 on which are mounted relay nozzles 6, stop motion 8, stretching nozzle 10 and reed 34. Also, selvage tuckers 32 to lay the cut thread ends into the fabric are provided as known for instance from WO 98/28474. The valve devices 5, 7 and 11 are connected to a compressed-air tank 33. The batten 28 is driven from the main drive motor 27 through a gear unit 35. The position of the batten 28 is detected by an encoder 36.

In an embodiment variation of the invention, the main drive motor 27 drives the batten 28 directly as known from WO 98/31856. In that case the encoder 38 shall determine both the position of the batten 28 and the position of the main drive motor 27. An airjet weaving machine moreover may contain further parts each controlled by a drive motor. The above listing of actual present and controlled elements is partial only.

The weaving rate is determined by the speed of the main drive motor 27 which may correspond for instance to that of the U.S. Pat. No. 5,617,901 or WO 98/31856 and which may be controlled at a defined speed. The above cited components of the airjet weaving machine are controlled according to a set of weaving parameter values by means of the airjet weaving machine's control unit 1. The control unit 1 is connected to a memory 29 storing at least one set of weaving parameter values. A set of weaving parameters includes time, pressure, airflow, position, speed, force and additional weaving parameters. The weaving parameter values are stored preferably in the memory 29 illustratively for each filling insertion of a weaving pattern in association with a weaving rate of the airjet weaving machine. The memory 29 may be housed in the control unit 1. However it may also be connected by means of a network including the control unit 1.

As regards the controlled valve device 5, 7 and 11, the weaving parameters are in the form of the pressure and/or airflow of the compressed air fed to one nozzle and the beginning and/or the duration of the compressed-air feed to the associated nozzle. As regards the controlled filling scissors 9, the weaving parameter is the time of cutting. As regards the prewinder 2, the weaving parameters are the time at which the magnetic clamp 3 releases a filling as well as the time at which the magnetic clamp 3 closes again. As regards the selvage device 17, the weaving parameters are represented by the position and the speed of the drive motor 18 for the selvage device and the particular position and/or speed of the batten relative to the selvage device 17 and in particular the time of crossing of the selvage threads as a function of the position of the batten 28. The latter consideration also applies to the drive motor 15 for the shed-forming means 13 controlling the warps and also to the drive motor of the selvage tuckers 32. As regards the drive motor 21 of the fabric takeoff device 22, the weaving parameter is the speed. As regards the drive motor 23 of the waste winding device 24, the speed is the weaving parameter. As regards the drive motor 19 of the warp letoff 20, the weaving parameter is the warp tension or the force exerted by the warps. As regards the thread brake 12, the weaving parameters are the time, the duration and the force of braking.

The description below assumes that with respect to the airjet weaving machine, the weaving parameters are selected and optimized for a given weaving pattern. The set of weaving parameter values is stored in the memory 29 for each filling insertion of the weaving pattern, these including the weaving rate. The particular elements are driven during weaving according to their weaving parameters.

When the weaving rate is changed for a given filling insertion, then the desired weaving rate shall be entered by means of an input unit 30. Illustratively the input unit 30 is a keyboard of the airjet weaving machine. However the input unit also may be a read unit of the airjet weaving machine for a memory card or a module of the control unit 1 which is coupled to a network. The instantaneous weaving parameter values to be matched to the changed weaving rate shall be determined by a processing unit 31 and then stored. The processing unit 31 may be part of the control unit 1 itself. However it may also be connected through a network to the control unit 1 of the airjet weaving machine. Illustratively at least one altering function to be described below may be entered and stored by the input unit 30 into this processing unit 31.

Next each weaving parameter of the optimized values of the set of weaving parameters is matched by the processing unit 31 according to a predetermined altering function to the changed weaving rate, as a result of which a new set of weaving parameters is formed. The new set of weaving parameter values then is selected by the control unit 1 for weaving at the changed weaving rate. In other words, the control unit 1 controls the weaving machine components to implement at least one filling insertion of a weaving pattern at the changed weaving rate according to the new set of weaving parameters. This procedure may be repeated for each particular filling insertion of a weaving pattern.

Illustratively, the altering function may be entered through the input unit 30. However the processing unit 31 may also calculate by itself the altering function, in particular with a set of weaving parameter values of a weaving-rate standard setting which is substantially the same as the weaving rate with optimized weaving parameter values and which, depending on a set of weaving-parameter values of a standard setting at a second weaving rate that is at least approximately equal to that weaving rate to which the weaving rate shall be changed. In another implementation of the present invention, and as described further below, the altering function is calculated in the processing unit 31 from optimally adjusted values of the weaving parameters and according to results of measurements.

One feasible altering function for adjusting the pressure at the main nozzle 4 may be attained as follows: If, for a standard setting, the pressure at a weaving rate of 600 insertions/min is 5 bars and at a standard setting at a weaving rate of 700 insertions/min it is 6 bars, then the altering function can be formed for a transition of 600 to 700 insertions/min using a coefficient of 6/5=1.2. The pressure then may be multiplied by this coefficient. If the optimized pressure value when weaving at a weaving rate of 600 insertions/min is 4 bars, and transition is desired from 600 to 700 insertions/min, then the above stated altering function leads to a pressure of 4.8 bars, that is 4 bars multiplied by 1.2 for a weaving rate of 200 insertions/min.

If for instance the weaving rate is changed from 600 to 650 insertions/min, the processing unit 31 illustratively may calculate the altering function by a rule of three. Based on the above example with the coefficient=1.2 for an altering function for the transition from 600 to 700 insertions/min, the rule of three calculation leads to a coefficient of 1.1 for the transition from 600 to 650 insertions/min. Then the adjusted value of the weaving parameter "pressure" at 650 insertions/min will be 4 bars times 1.1=4.4 bars.

In another approach, the altering function may consist in adding a constant. This may be explained, for instance, with respect to the time at which the filling scissors 9 will be cutting. If a standard setting specifies the value for cutting by the filling scissors at 600 insertions/min at a crank angle of 120° and a standard setting specifies cutting at 125° for 700 insertions/min, then illustratively the altering function consists in adding 5°. If for optimized adjustment cutting takes place at 116° for a weaving rate of 600 insertions/min, then using the altering function (+5°) this parameter shall be set at 121° for 700 insertions/min.

In the manner described above, and using an altering function, a value matching the changed speed shall be ascertained and adjusted for each weaving parameter. The altering functions are not restricted to addition or multiplication. Other mathematical and/or statistical calculations also are appropriate such as taking the mean, using the squares of errors, and other functions. An altering function may be determined more accurately the more standard settings of weaving-parameter values for predetermined weaving rates are known.

An altering function need not mandatorily be entered through the input unit 30 into the processing unit 31. Nor is it necessary that the processing unit 31 determines the altering function on the basis of the standard settings of weaving-parameter values as entered through the input unit. Most of the time a more accurate altering function will be attained when it is determined on the basis of optimally adjusted sets of weaving-parameter values at two or more different weaving rates. The altering function may be determined in that the two sets of weaving-parameter values be compared and in that the associated coefficients, factors and/or constants shall be determined. When sets of optimized weaving parameters for several weaving rates are known, statistical methods may be applied to ascertain the altering function.

When a set of weaving-parameter values is automatically adjusted as a function of measured data, for instance the time of filling arrival in a stop motion 8, then the associated altering function also may be adjusted correspondingly when adjusting the weaving parameters. In the above instance, the altering function was a coefficient of 1.2 based on the values of the weaving-parameters' standard settings. If the calculation had been based on the adjustment of optimized weaving-parameter values, a coefficient of 1.18 for instance would have resulted. Also the coefficient would have been 1.17 if automatically adjusting the weaving parameters on the basis of weaving data.

Moreover the altering function may be ascertained based on weaving-parameter values for a fabric which differs from that fabric for which the altering function was meant. The standard setting determining the basis of the altering function may also be determined using standard settings of another fabric—preferably however a similar one.

When determining the altering function, one may take into account another altering function that already was determined and take into account the changed weaving rate. When two altering functions for an ever recurring transition from a first weaving rate to a second one are known, then, on the basis of these two altering functions, a new one for transiting to other weaving rates may be determined. If for instance an altering function, such as a coefficient of 1.2 for a transition from 600 to 700 insertions/min and another altering function, for instance a coefficient of 1.4 (or 1.2+0.2) for a transition from 700 to 800 insertions/min are known, then a change for a transition from 800 to 900 transitions/min may be determined in simple manner, for instance a coefficient of 1.6, that is 1.4+0.2.

The invention is especially appropriate for weaving according to a speed pattern wherein the filling insertions are woven at different weaving rates. In a simple illustration, two fillings are woven according to one filling pattern and one speed pattern. A first filling A for instance may be processed at up to 800 insertions/min whereas a second filling B may be woven only up to 600 insertions/min. The filling pattern illustratively comprises the sequential weaving of a filling A, A, A, A, A, B, B, A, B and B. In such a case the speed pattern would be selected as follows: 700, 800, 800, 800, 700, 600, 600, 700, 600, and 600 insertions/min. This means that the filling B always shall be processed at maximum speed, whereas the filling A, before or after transition to the filling B, shall be processed at a lower speed and at maximum speed for the remaining filling insertions. In the process the operator optimizes the weaving parameters for the filling A at a weaving rate of 800 insertions/min. As regards the insertions of the filling B, the operator optimizes the weaving parameters for 600 insertions/min. Thereupon the operator adjusts the weaving parameters of the filling A correspondingly in accordance with the method of the invention in order to attain appropriate weaving parameters to weave the filling A at 700 insertions/min which he/she then again may easily optimize. As a result the weaving parameters may be rapidly optimized for 700 insertions/min.

Following the optimization of the weaving parameters for the filling A at 700 or at 800 insertions/min, the processing unit 31 may determine a more accurate altering function. If thereupon the weaving parameters to weave at 800 insertions/min are automatically changed in relation for instance to the filling arrival time, then the weaving parameters for 700 insertions/min also may be adjusted in relation to the altering function. This feature shall be advantageous, for instance, when the properties of the filling A change in relation to its position in a supply spool as is the case for instance with filament yarns. The weaving parameters may be changed by the described procedure to insert a filling at 700insertions/min, whereby wrong filling insertions may be prevented. Obviously the weaving parameters at 700 insertions/min of the filling A may be further adjusted on the basis of measured data and the altering function may be optimally adjusted on the basis of several sets of weaving parameters.

The invention is less advantageous when changing a weaving rate for instance of 700 insertions/min to 702 insertions/min. In that case the weaving parameters may be adjusted automatically in known manner as a function of measured data. The foremost goal of the present invention is to take care of relative large changes in weaving rates, for instance changes from 700 insertions/min to at least 720 insertions/min. In that case automatic adjustment most of the time shall be inadequate and therefore a departure from the standard settings shall be required. Even when automatic adjustments are feasible, they are usually too sluggish and hence such a change in weaving rates entails machine stoppage because the filling might arrive outside tolerance at the stop motion 8. In such a circumstance it is rarely the case that the airjet weaving machine may be restarted with the existing setting of weaving parameters. Several weaving parameters then must be manually changed, or else the start must be at a standard setting or at lower weaving rates.

Where substantial changes in weaving rates are involved, they may be carried out stepwise. If for instance the transition is from 700 to 1,000 insertions/min, then a first step may be a transition to 800 insertions/min, the set of new values of weaving parameters being determined in the manner of the invention and then being optimized. Based on the optimized set of weaving-parameter values, the transition to 900 insertions/min may be carried out in a second step. Using an altering function, a new set of weaving-parameter values may then be determined in the manner of the invention and these can then be optimized. In corresponding manner thereupon the transition is carried out to 1,000 insertions/min. The weaving parameters at 800 or 900 insertions/min need not necessarily be adjusted optimally. The optimization may be restricted to approximately adjusting the weaving parameters in the right direction.

In an advantageous embodiment, the weaving parameters at 800 and 900 insertions/min preferably are adjusted as a function of measured data. As a result, an approximately optimal setting at these 800 or 900 insertions/min may be attained on the basis of which optimization of adjustment at 1,000 insertions/min may be attained by means of the method of the invention that shall require no correction or only very little on the part of the operator.

An associate altering function may be determined for each different filling to be woven, and said altering function may differ from one between different weaving rates for another filling. A given filling type, for instance a fibrous filling, will require lesser matching of the pressure of the main nozzle 4 when the weaving rate is changed than a smooth filling which is subjected to a lesser force from the air issuing from the main nozzle 4.

The measured data constituting the basis of the set of weaving-parameter values are not restricted to the measurements of the arrival time of a filling at a stop motion. These measured data also may consist of the manufactured fabric image picked up by a ware viewing system or of the image of the produced selvage picked up by a ware viewing system. Based on the image picked up by a ware viewing system, the weaving parameters for the shed-forming means 13 or for the selvage device 17 may be automatically adjusted. It is clear that once it has been optimally set, a weaving machine at a given weaving rate may weave approximately optimally at any other weaving rate without requiring operator intervention, the more weaving parameters are automatically adjusted and the more accurately the altering function may be determined.

Obviously the ascertaining of a new set of weaving-parameter values on the basis of the optimized weaving-parameter values and an altering function is not restricted to the above discussed embodiment and implementing modes. According to one variation, an altering function is determined on the basis of the optimized weaving-parameter values and another set of the weaving-parameter values—for example, a set of the weaving-parameter values of a standard setting at the weaving rate at the time. When changing the weaving rate, a new set of weaving-parameter values is determined according to this variation in that for instance another set of the weaving-parameter values of a standard setting is matched at the changed weaving rate according to the above cited altering function which in turn is determined on the basis of the optimized values of the weaving parameters.

The method of the invention is especially advantageous when weaving according to a speed function which illustratively changes during weaving depending on the power applied to the weaving machine. This may mean in the light of the above discussed example that the transition from 600 through 700 to 800 insertions/min is changed into a transition from 600 through 680 to 800 insertions/min provided it is found that this change is advantageous with respect to the power applied to the main drive motor 27 or to several other drive motors of the weaving machine. Due to the method of the invention, the change from 700to 680 insertions/min relating to filling insertion may take place in the manner of the method of the invention without the operator being required to optimize the associated set of weaving-parameter values.

As regards a gripper weaving machine, the weaving parameters are for instance the control times to open the gripper clamps, as known from WO 97/40218, the speed function of the gripper-tapes by means of which the gripper are driven by a controlled motor into the shed, the time at which the filling presenting device is moved upward following a filling insertion, as known from U.S. Pat. No. 5,400,834, and other weaving parameters.

The invention is not restricted to airjet weaving machines or gripper weaving machines. It may also be applied to adjust waving parameters of other weaving machines. Among such other weaving machines are multi-phase weaving machines such as weaving rotors or the like, gripper shuttle weaving machines, water jet weaving machines, projectile machines or other weaving machines. The invention primarily applies to weaving fabrics wherein different fillings with different bindings are woven with warps and very especially to such weaving which takes place at different machine speeds. Obviously the invention shall be in its most advantageous form when many weaving parameters must be adjusted. This applies most of all to weaving machines wherein several parts are driven by their own drive motors which in turn are controlled by a control unit of the weaving machine.

The method of the invention furthermore offers the advantage that, assuming several adjustments at a particular weaving machine, it may be applied in simple manner to an existing machine. The invention will be in its most advantageous form with respect to a weaving machine fitted with a main drive motor 27 that can be controlled with respect to speed because the adjustments in this case are limited to installing a system of the invention.

Obviously the invention is not restricted to the embodiments and implementations illustratively described in the text and shown in the drawing. Other variants are feasible within the scope of the present invention.

What is claimed is:

1. A method of adjusting weaving parameters of a weaving machine, comprising the steps of:

automatically altering weaving parameter values, including at least a weaving parameter for the weft inserting time that are set for an instantaneous weaving rate by using one or more altering functions when the instantaneous weaving rate is changed to another weaving rate.

2. Method as claimed in claim 1, wherein the determination of instantaneous, optimized set of weaving parameters is carried out for each filling insertion of a weaving pattern and in that the determination of a new set of weaving parameters for the filling insertion of the weaving pattern is carried out at a changed weaving rate by adjusting the instantaneous optimized set of the weaving parameters by means of an altering function.

3. Method as claimed in claim 1, wherein the altering function is determined relative to at least one optimally adjusted set of weaving parameters at a predetermined weaving rate.

4. Method as claimed in claim 1, wherein when transiting from a first weaving rate appropriate for one kind of filling at a suitable weaving rate to a second weaving rate appropriate for one kind of filling, intermediate steps of weaving rates each with associated values of weaving parameters are ascertained and adjusted.

5. A control system to carry out the method of claim 1, comprising means to adjust weaving-parameter values of at least one weaving machine fitted with means to enter weaving-parameter values and with memories of weaving-parameter values, wherein means are provided using instantaneous weaving-parameter values for one weaving rate and one or more altering functions when changing to another weaving rate, to thereby ascertain and adjust weaving-parameter values matched to the other weaving rate.

6. A method of adjusting weaving parameters of a weaving machine, comprising the steps of:

automatically altering weaving parameter values that are set for an instantaneous weaving rate by using one or more altering functions when the instantaneous weaving rate is changed to another weaving rate;

wherein the altering function(s) are derived from weaving-parameter values which are predetermined for at least two different weaving rates.

7. A method of adjusting weaving parameters of a weaving machine, comprising the steps of:

automatically altering weaving parameter values that are set for an instantaneous weaving rate by using one or more altering functions when the instantaneous weaving rate is changed to another weaving rate;

wherein each time at least one set of weaving-parameter values is stored in a memory for several weaving rates and in that upon changing the weaving rate from a first weaving rate to a second weaving rate at least one altering function is ascertained or selected that comprises weaving parameter differentials which are stored in the memory in addition to weaving rates that each correspond at least approximately to the first and second weaving rates.

8. Method as claimed in claim 7, wherein weaving-parameter values are the basis for establishing the altering function(s), said values being stored in a memory as standard values for two or more weaving rates.

9. Method as claimed in claim 7, wherein weaving-parameters values are the basis for establishing the altering function(s), where said values are stored in a memory as optimized values for two or more weaving rates.

10. A method of adjusting weaving parameters of a weaving machine, comprising the steps of:

automatically altering weaving parameter values that are set for an instantaneous weaving rate by using one or more altering functions when the instantaneous weaving rate is changed to another weaving rate;

wherein two or more different kinds of fillings are woven in a fabric and in that appropriate values of weaving parameters for each kind of filling are stored in a memory and are each retrieved and adjusted when the fillings are inserted.

* * * * *